US005607075A

United States Patent [19]

Burgdorf et al.

[11] Patent Number: 5,607,075

[45] Date of Patent: Mar. 4, 1997

[54] LARGE-CAPACITY LIDDED DRUM

[75] Inventors: Märten Burgdorf, Heimerzheim; Dietmar Przytulla, Kerpen, both of Germany

[73] Assignee: Mauser-Werke GmbH, Brühl, Germany

[21] Appl. No.: 429,015

[22] Filed: Apr. 26, 1995

Related U.S. Application Data

[63] Continuation of Ser. No. 133,041, filed as PCT/EP92/01042, May 13, 1992, published as WO92/21576, Dec. 10, 1992, abandoned.

[30] Foreign Application Priority Data

May 25, 1991 [DE] Germany ..... 9106443 U

[51] Int. Cl.[6] ..... B65D 45/32

[52] U.S. Cl. ..... 220/319; 220/608; 206/505; 206/519

[58] Field of Search ..... 220/319, 320, 220/606, 608, 635, 771, 357, 358, 306; 206/519, 505, 506, 675

[56] References Cited

U.S. PATENT DOCUMENTS

| | | | |
|---|---|---|---|
| 3,804,289 | 4/1974 | Churan | 220/306 |
| 3,949,877 | 4/1976 | Santoni | 206/519 |
| 4,709,833 | 12/1987 | Granberg et al. | 220/675 X |
| 4,928,839 | 5/1990 | Kruelskie | 206/519 X |
| 5,018,642 | 5/1991 | Pyzytulla | 220/675 |
| 5,143,219 | 9/1992 | Yates, Jr. | 220/306 X |
| 5,190,157 | 3/1993 | Przytulla | 206/519 |
| 5,193,715 | 3/1993 | Schultz | 220/675 |
| 5,292,024 | 3/1994 | Koefelda et al. | 220/306 X |

FOREIGN PATENT DOCUMENTS

| | | | |
|---|---|---|---|
| 1009166 | 4/1977 | Canada | 206/519 |
| 2431962 | 3/1980 | France | 206/519 |
| 2109956 | 9/1972 | Germany | 206/519 |

*Primary Examiner*—Jes F. Pascua
*Attorney, Agent, or Firm*—Henry M. Feiereisen

[57] ABSTRACT

The invention relates to a conical lidded drum made of thermoplastic.

To avoid step-like changes in diameter or hollow borders as a stacking rim on the outer drum body, according to the invention, a second upset surface flange (12) is formed out in the region of the upper third of the drum (34) on the outer wall of the drum body (10). Advantageously, the conical drum wall (14) extends linearly in a straight line from the upper first surface flange (20) down to the vicinity of the drum base (18) over the entire periphery and in drum longitudinal direction. A third upset surface flange may be provided as a bottom rolling ring (38) in the transition region from drum wall to drum base.

24 Claims, 4 Drawing Sheets

LARGE-CAPACITY LIDDED DRUM

This is a continuation of application Ser. No. 08/133,041, filed as PCT/EP92/01042, May 13, 1992, published as WO92/21576, Dec. 10, 1992, now abandoned.

BACKGROUND OF THE INVENTION

The invention relates to a large capacity blow-moulded lidded drum (wide-necked packing drum) made of thermoplastic plastic for storing and transporting hazardous liquid or solid contents, having a substantially conical drum body which has, on its outer wall in the vicinity of the upper charging opening, a circumferential surface flange for the gas- and liquid-proof fastening of a drum lid by means of an overlapping tension ring, a stacking rim being provided on the outer wall of the drum body in the region of the upper third of the drum to allow a plurality of such conical lidded drums to be stacked one inside the other.

The invention does not relate to small conical packing drums manufactured using the injection moulding technique, such as, for example, paint buckets or the like.

Conical lidded drums, when empty, may be stacked one inside the other and therefore offer the major advantage that, despite their large dimensions, they are economical in terms of freight space and cost during dispatch and are correspondingly economical to store when empty.

A conical plastic lidded drum of the type described is known, in which the drum body is provided with a discontinuous step-like diameter increase in the region of its upper third, with the drum wall being cylindrical from said diameter increase up to the upper drum opening. By virtue of the projecting wall step, an outer stacking rim is provided and an upper lidded drum nested into a lower drum may be supported on the upper drum rim of the charging opening of the lower drum, thereby preventing a plurality of nested drums from becoming wedged one inside the other so that they are virtually impossible or require a great deal of effort to separate again. Said drums, in a stable construction with an appropriate wall thickness, have proved successful as reusable packaging. In the case of lightweight drums of reduced wall thickness, however, the stability under load of a stack could become limited or critical when a plurality of full drums are stacked one on top of the other.

Another conical industrial drum is provided in its upper wall region with a plurality of spaced-apart calottes, which are formed so as to project outwards and each have on their outer bottom edge an axial stop face as a stacking edge. As a result, however, there are corresponding pockets or partial bulges in the drum inner wall which are a drawback in the final stages of emptying the drum because residues of adhesive contents may remain in said pockets and make it difficult to clean the drums for re-use.

A plastic rain barrel having an, in particular, conical drum body is also known. This rain barrel of a different generic type is, however, a stationary container and is also not suitable for transporting, in particular, hazardous liquid or solid contents because the barrel cannot be tightly sealed. Admittedly, the uppermost rim of the charging opening is flanged outwards almost at right angles and forms the supporting surface for a barrel lid which is inserted into the barrel opening and rests on the flanged rim but, in the absence of a sealing facility and a difference in diameter between barrel flange and lid rim, said barrel lid cannot be fixed by means of a tension ring in a liquid-proof manner on the barrel opening. Nor was there in any way provision for this because the lid has a non-closable central inlet opening for the collection of rain water and moreover merely serves, for example, to prevent leaves or other particles from falling into the barrel.

SUMMARY OF THE INVENTION

The object of the present invention is to propose a blow-moulded conical lidded drum made of thermoplastic, with which the possibility of nesting empty drums one inside the other and stacking full drums, each tightly closed with a lid and tension ring, one above the other as well as subsequent trouble-free internal cleaning ready for multiple use is fully retained and yet it is possible to reduce the drum wall thickness, with a saving in the plastic raw material used, to achieve a lightweight drum construction.

This object is achieved according to the invention in that the stacking rim takes the form of a second, substantially radially projecting surface flange extending around the entire circumference. By providing, as it were, an additional component in the form of the second radially projecting surface flange on the drum outer wall, the entire drum body remains free of sudden changes in diameter or outwardly-extending bules in the drum wall. To cope with the comparatively low stressing of the second surface flange when a plurality of empty drums are nested one inside the other, it is sufficient if the surface flange is approximately one and a half to two times as thick as the drum wall.

Preferably, the stacking rim surface flange is upset from the material of the drum wall in a single working process, directly in the blowing mould during shaping of the hollow body, by means of suitable mould slides. In principle, however, the surface flange could alternatively be glued or welded as a separate prefabricated injection moulded part onto the drum wall. Thus, it is also conceivable to provide the surface flange, not extending around the entire circumference, but discontinuously or only in segments on the outer wall of the conical drum body. The additional surface flange lends the comparatively thin-walled drum body increased radial rigidity and stacking stability for stacking a plurality of full drums one above the other.

Advantageously, the conical drum wall is designed so as to be linearly straight-lined from the upper first surface flange down to the vicinity of the drum base over its entire periphery in the drum longitudinal direction; as a result of shaping the drum in this manner, the drum wall continuously tapers uniformly downwards with a high rigidity of the drum wall against axial pressure load or stack loads despite a reduced drum wall thickness of, for example, 5.5 mm compared with a conventional drum wall thickness of around 7.5 mm in a comparable known conical lidded drum.

When empty drums are nested, the drum according to the invention is supported by the lower edge of the second radially projecting surface flange as a stacking rim on the drum upper edge of a drum stacked below. Since, according to a further feature of the invention, the inner wall of the drum body is designed so as to be free of bulges or hollow ring borders, being rectilinearly flat and smooth throughout particularly also in the region of the upper surface flange and the second stacking rim surface flange, reconditioning of the drums according to the invention for re-use is also perfectly simple and straightforward.

Since the main aim of the invention is geared inter alia towards a reduction in the required drum wall thickness, it may be advantageous if the drum body has below, in the transition region from conical drum wall to drum base, a circumferential, stable and solid bottom rolling ring. As a result, in the event of oblique rolling of a full drum in an inclined or tilted drum positioning by hand by a handler, the partial pressure load of the outer rim of the drum base is distributed over a wider reinforced peripheral region, and denting of the drum base at the relevant point of contact and any associated flexing work in the plastic material is reliably prevented.

According to the invention, the drum body of the new lidded drum may, when viewed in cross-section, present a rectangular or square drum shape with rounded-off corners. This offers considerable advantages in terms of utilizing available space if, for example, the drums are stored or transported tightly packed on pallets or in standard containers.

It is technically feasible to prefabricate the upper first surface flange for fastening the lid, the second stacking rim surface flange or/and the bottom rolling ring each as a separate injection moulded part which is then glued or welded onto the conical drum body. According to a further feature of the invention, it is however provided that the surface annular flanges (including the bottom rolling ring) are all constructed as integral solid parts from the thermoplastic plastic tube or from the drum wall as a result of upsetting, simultaneously with blow moulding, by means of mould slides provided in the blowing mould. Thus, the drum body may be manufactured with three circumferential surface flange rings in a single working process from the same homogeneous material. This is advantageous for the overall stability and fall strength of the drum body.

BRIEF DESCRIPTION OF THE DRAWINGS

The invention is explained and described in greater detail hereinafter with reference to embodiments which are illustrated in the drawings. In the drawings.

DETAILED DESCRIPTION OF PREFERRED EMBODIMENTS

Figure 1:
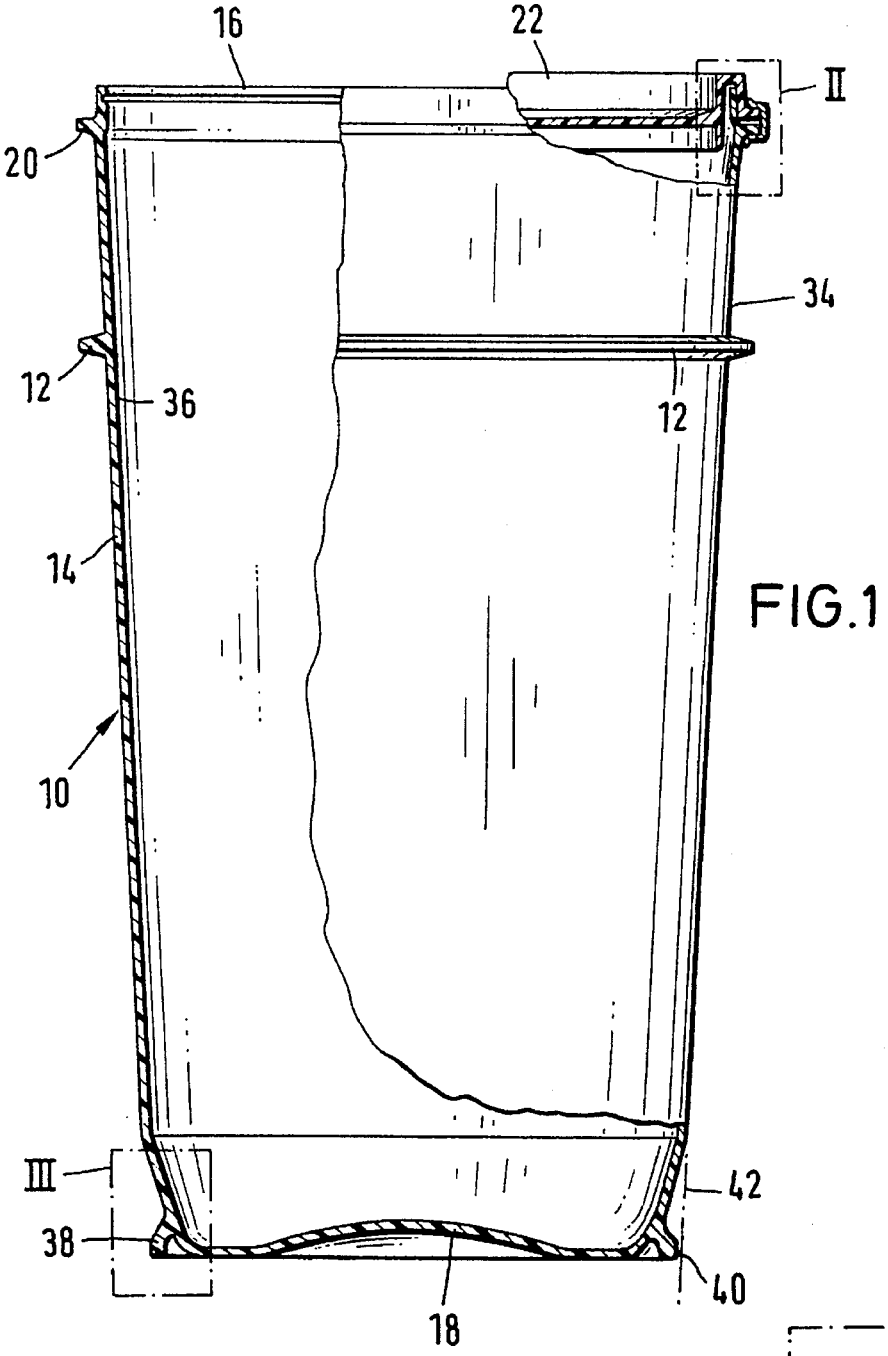
FIG. 1 shows a conical lidded drum according to the invention in a part-sectional side view.

In FIG. 1, the reference numeral 10 denotes the drum body of a large-capacity lidded drum made of thermoplastic (wide-necked packing drum having a capacity of, for example, 150 litres, 160 litres or 200 litres). To allow empty drums to be nested one inside the other for transport purposes, the conical drum wall is designed so as to be linearly straight from the upper first surface flange 20 down to the vicinity of the drum base 18 over the entire periphery and in drum longitudinal direction, and a second surface flange 12 is disposed as a stacking rim on the outer wall of the drum body 10 in the region of the top third of the drum 34. This guarantees a high axial rigidity. The inner wall 36 of the drum body 10 is designed so as to be rectilinearly smooth throughout, especially also in the region of the upper surface flange 20 and the second stacking rim surface flange 12 as well as in the region of the bottom rolling ring 38. This is advantageous for emptying residues and for internal cleaning of the drums for multiple use.

Figure 3:
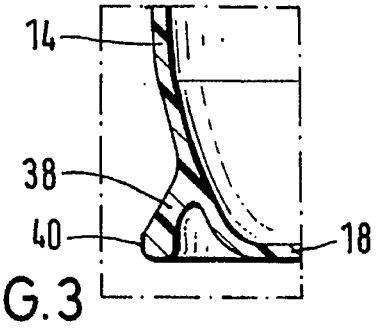
FIG. 3 shows an enlarged detail from the bottom left of FIG. 1.

To increase its radial rigidity, according to an advantageous development the drum body 10 has below, in the transition region from conical drum wall 14 to the drum base 18, a circumferential solid bottom rolling ring 38, as may be seen in the enlarged view of FIG. 3. The slightly conical drum wall 14 has, in the lower region towards the bottom rolling ring 38, a greater degree of taper than in the upper conical drum body 10, such that the bottom rolling ring 38 has a reduced diameter and the radial outer edge 40 of the bottom rolling ring 38 lies within the extension line 42 of the upper slightly conical drum wall 14 (FIG. 1). The drum base 18 is cambered slightly inwards or concave in the middle; it could however alternatively be smooth and flat, as shown in FIG. 4.

Figure 2:
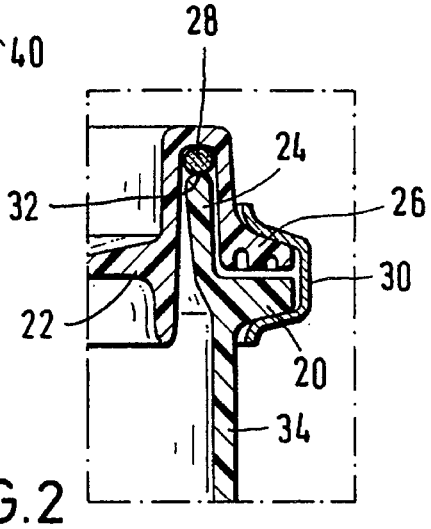
FIG. 2 shows an enlarged detail from the top right of FIG. 1.

As is shown more clearly in FIG. 2, the drum lid 22 has an inner lid ring engaging into the drum charging opening 16 and an outer rim which overlaps the drum upper rim 24 and has an outer flange 26 extending radially therefrom. Disposed in the annular recess left free between inner lid ring and lid outer rim is a sealing ring 28 which, when the lid 22 is clamped on by means of a tension ring 30, seals the drum opening 16 against the drum upper edge 32 of the drum upper rim 24 engaging into the annular recess.

Advantageously, the tension ring 30 is equal-sided and may be fitted in any manner, without having to observe a particular orientation, and tightened over the surface flange 20 of the drum body 10 and the outer flange 26 of the drum lid 22.

Figure 4:
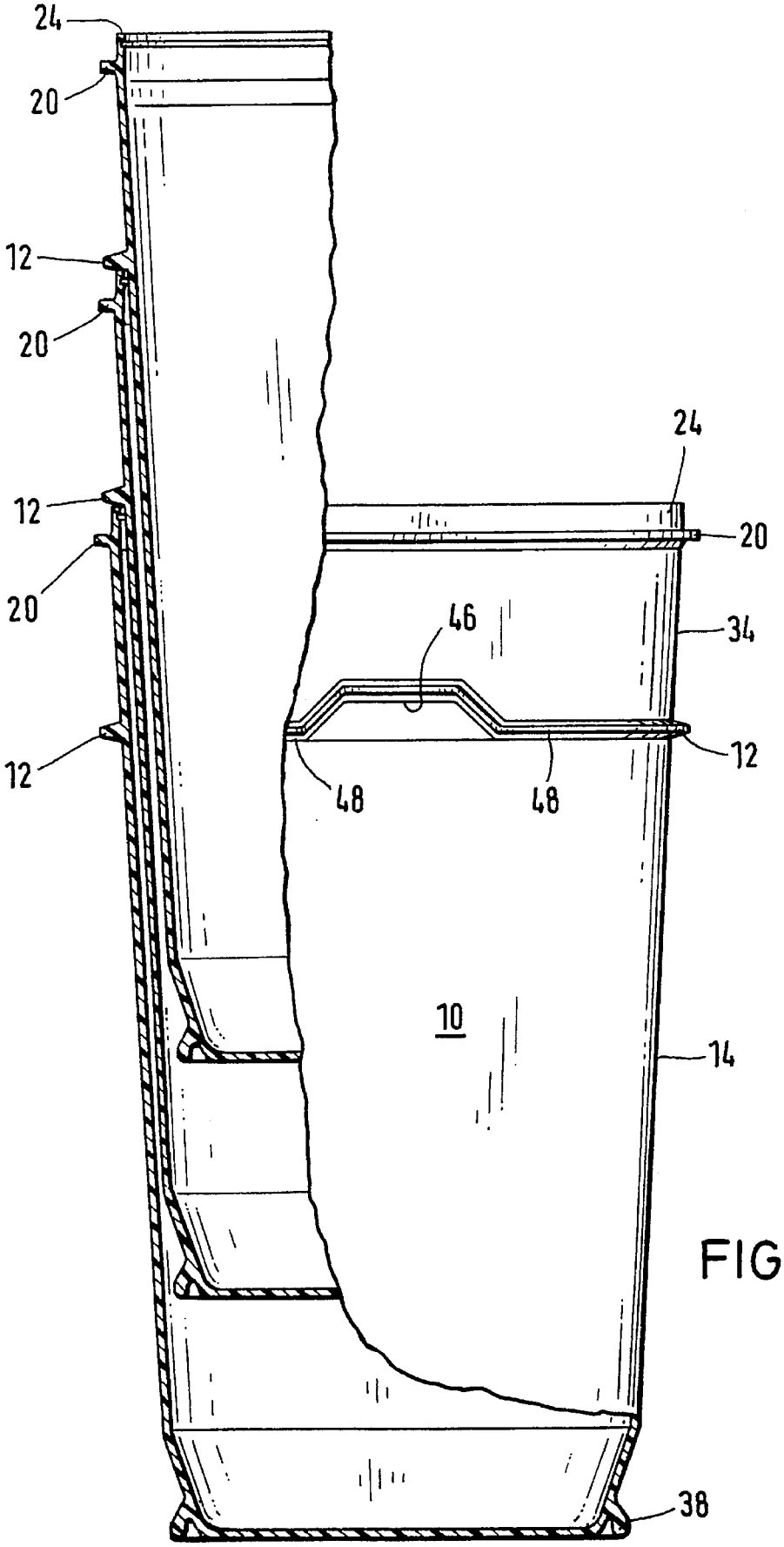
FIG. 4 shows a side view with a part-sectional view of three empty drums nested one inside the other.

FIG. 4 shows three empty drums nested one inside the other. From this it is evident that an upper nested drum is supported by the underside of its stacking rim surface flange 12 on the drum upper edge 32 of the upper drum rim 24 of the drum 10 nested below and an air space is left between the inner wall of the lower outer drum and the outer wall of the inner drum nested above, so that the drums are reliably prevented from becoming wedged and sucked into one another with vacuum or partial vacuum formation, which makes it very difficult to remove drums from the stack.

FIG. 4 shows a further variation of the stacking rim outer flange according to the invention. Here, the stacking rim surface flange 12 is also continuous but, in order to provide an engagement means directly on the stacking rim surface flange 12 for grasping and lifting out the top drum of a plurality of nested empty drums, the surface flange 12 is offset slightly upwards in segments at, at least two, preferably four diametrically opposed points. The flange could in principle alternatively extend in a uniformly undulating manner. Thus, engagement recesses 46 are formed in each of the raised segments (wave crests), while the lower segments 48 (wave troughs) are, as before, the stacking rim support surface associated with the drum body nested below. The length of an engagement recess 46 in a peripheral direction is in each case between 80 and 120 mm.

Figure 5:
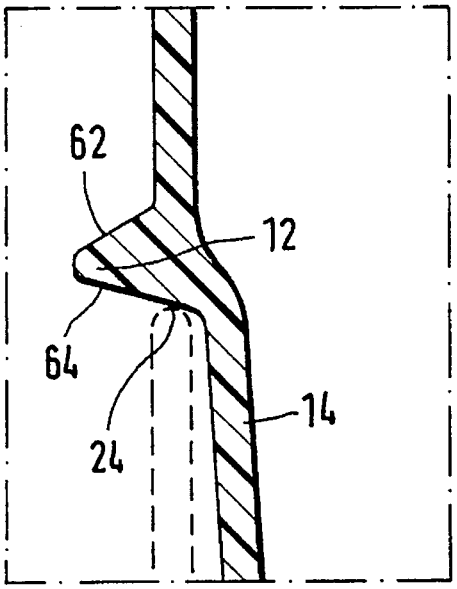
FIG. 5 shows a detail sectional view of the drum wall in the region of the stacking rim surface flange.

FIG. 5 shows an enlarged detail of the drum wall 14 in the region of the second surface flange 12 or stacking rim. Here, the drum wall in the upper third of the drum body above the surface flange 12 is not conical but perfectly cylindrical; below the surface flange the drum wall tapers rectilinearly. The radially projecting surface flange 12 is solid and is virtually triangular in cross-section with an oblique upper surface 62 ascending towards the drum wall and an oblique lower surface 64 (= stack support surface) descending towards the drum wall. Externally, the flange rim is approximately the same thickness as the drum wall and on the inside the flange rim is approximately twice as thick as the drum wall. Diagrammatically illustrated by the dashed lines is the drum upper rim 24 of a drum stacked below, on which the surface flange 12 of the drum stacked above is supported by its lower surface 64.

Figure 6:
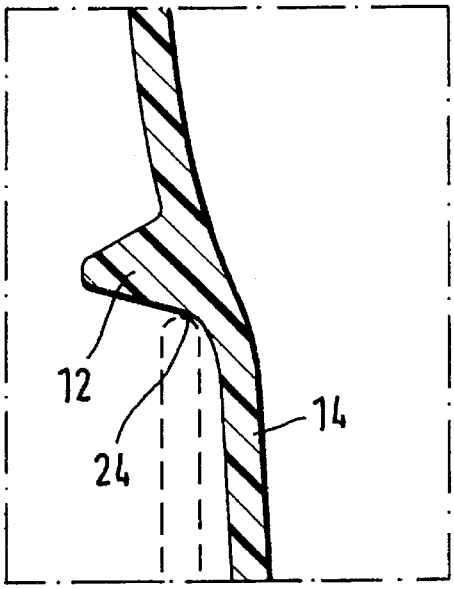
FIG. 6 to FIG. 8 show further detail sectional views with modifications according to the invention in the region of the drum wall with stacking rim surface flange.

In the variant of the conical lidded drum shown in FIG. 6, the drum body in the region of its upper third above the surface flange 12 is cambered slightly outwards (curved in a convex manner).

Figure 7:
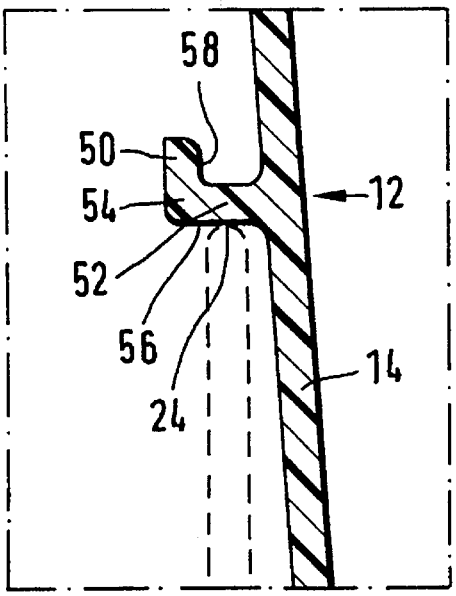

In the further drum variant shown in FIG. 7, the drum wall extends continuously rectilinearly from top to bottom. Here, in an advantageous development, the stacking rim surface flange is formed as a handling ring 54. The handling ring 54 (carrying and supporting ring) is substantially L-shaped in cross-section, having a vertical outer limb 50 and a horizontal inner limb 52; the horizontal limb 52 is directly connected to the drum wall 14. To allow the grab claws of a drum grab to engage, the vertical limb 50 has on its inside a vertical locating face 58 and the horizontal limb 52 has below a horizontal locating face 56 which also serves as a stack support surface when empty drums are nested one inside the other.

Figure 8:
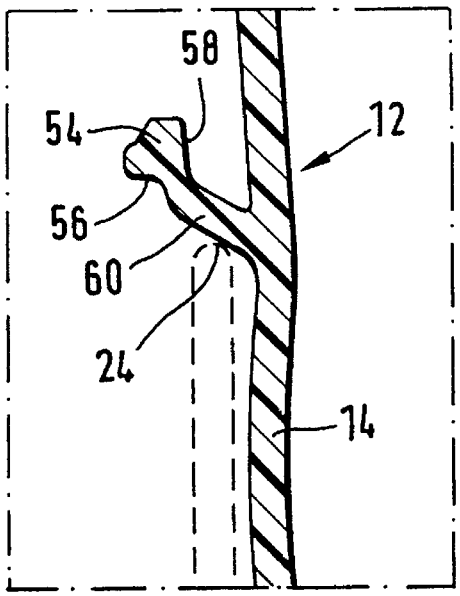

Finally, FIG. 8 shows a further possible drum variation. Here, the drum wall above the handling ring 54 or surface flange 12 tapers rectilinearly and below the surface flange 12 is cambered slightly outwards (curved in a convex manner) and likewise tapers. The handling ring 54 shown here is substantially rectangular in cross-section and likewise has a lower horizontal locating face 56 and an inner vertical locating face 58 for engagement of the grab claws of the drum grab. Here, the handling ring 54 is however connected, not directly, but via a, to some extent elastic, connection web 60 to the drum wall 14, with the underside of the connection web 60 serving as the stacking rim for the drum upper rim 24 of a second drum stacked below.

Figure 9:
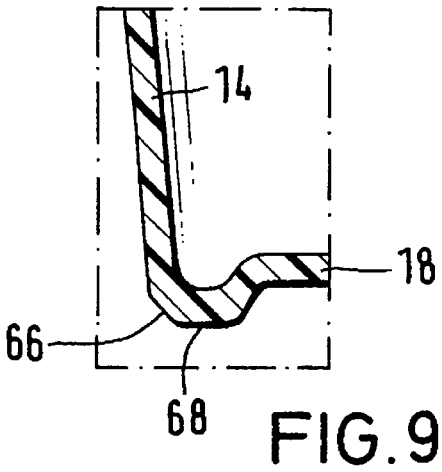
FIG. 9 shows a detail sectional view of the lower drum wall in the transition region to the drum base and FIG. 10 shows a plan view of a further plastic lidded drum according to the invention which is rectangular in cross-section.

The handling rings shown in FIGS. 7 and 8 are advantageously provided at at least one point with a bore to allow rain water to run off. Another possibility for a reinforced design of the rim of the drum base is shown in FIG. 9. By purposeful nozzle control, a build-up of material may be arranged in said drum region and, as a result of the special structural design of the blow-moulded drum body, improved radial rigidity in the event of oblique rolling of a full drum may be achieved. Here, the outermost edge of the drum base 18 or the lowermost region of the conical drum wall has a narrow bevelled rolling rim 66. The drum base is cambered inwards (curved in a concave manner) or slightly raised in the middle so that only a comparatively narrow flat peripheral surface is left adjoining the rolling rim 66 as a standing surface 68 for the lidded drum.

Figure 10:
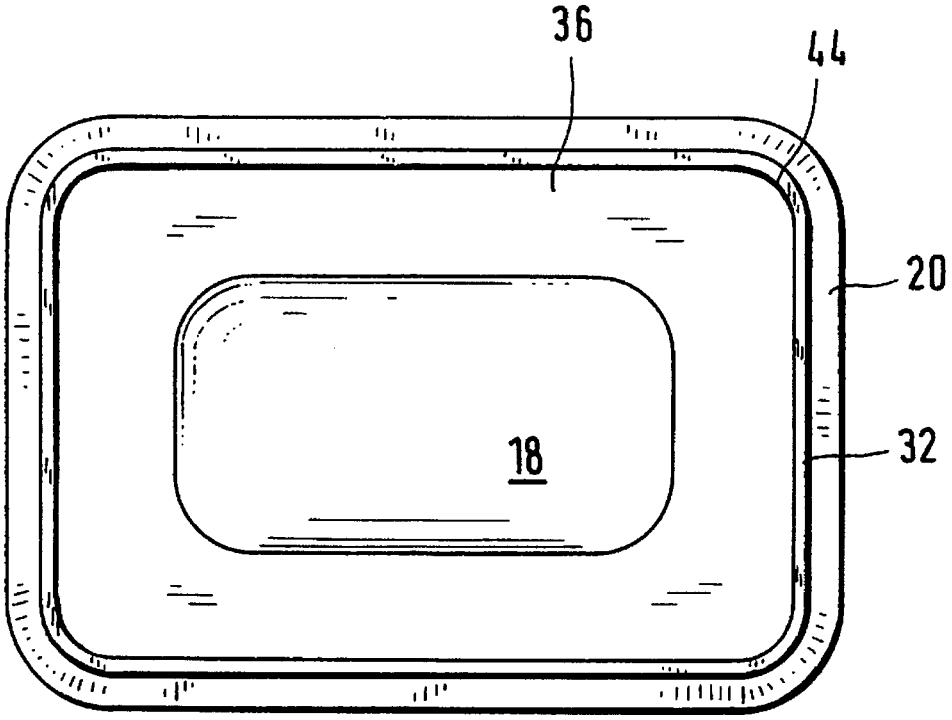

Finally, FIG. 10 shows a plan view of a further embodiment of the drum according to the invention; here, the drum body, when viewed in cross-section, presents a rectangular drum shape with rounded-off corners 44. The lidded drum could, of course, alternatively present a square basic shape.

The features described and illustrated may be varied or combined in any way within the scope of the invention.

From all this it is clear that the features according to the invention of the new conical lidded drum made of thermoplastic make it possible to reduce the drum wall thickness (lightweight construction) while retaining stacking stability when full drums are stacked one above the other. Thus, the drum body of a lidded drum according to the invention made of HDPE and having a capacity of 150 litres weighs only about 5.3 kg, while a comparable known conical lidded drum requires an empty drum weight of around 6.9 kg.

We claim:

1. A large-capacity blow-moulded lidded drum of thermoplastic material for storing and transporting hazardous liquid or solid contents, comprising:

a drum body (10) having a drum wall (14) that tapers downwardly and exhibits an upper charging opening; and a drum base, said drum wall being provided on its outer wall surface in vicinity of the upper charging opening (16) with a first circumferential, substantially radially projecting surface flange (20) for a gas- and liquid-proof fastening of a drum lid (22) by means of an overlapping tension ring (30) which engages the drum lid (22) and the first surface flange (20), said drum wall further including a stacking rim in the form of a second, substantially radially projecting surface flange (12) extending around the entire circumference of the outer wall surface below said first surface flange to allow nesting of a plurality of such drum bodies, wherein the drum wall extends linearly in a straight line from the first surface flange (20) to the second surface flange (12) and from the second surface flange (12) down to the vicinity of the drum base (18) over its entire outer periphery in the drum longitudinal direction, and has an inner wall surface (36) which is rectilinearly smooth in the region of the first surface flange and of the second surface flange and extends in a linearly straight line from the first surface flange (20) down to the vicinity of the drum base, wherein the second surface flange (12) is continuous and is offset slightly upwards in segments at, at least two, diametrically opposed points, and engagement recesses (46) for engagement by hand are provided in each of the upwardly offset segments.

2. A lidded drum according to claim 1 wherein the drum body (10) is provided with a circumferential bottom rolling ring (38) between a lower end of the drum wall (14) and the drum base (18).

3. A lidded drum according to claim 2 wherein the conical drum wall (14) has in the lower region towards the bottom rolling ring (38) a greater degree of taper than in the upper conical drum body (10), such that the bottom rolling ring (38) has a reduced diameter and the radial outer edge (42) of the bottom rolling ring (38) lies within the extension line (42) of the upper conical drum wall (14).

4. A lidded drum according to claim 2 wherein the bottom rolling ring (38) is formed in one piece with the drum wall (10).

5. A lidded drum according to claim 1 wherein the drum body (10), when viewed in plan, presents a substantially rectangular drum shape with rounded corners (44).

6. A lidded drum according to claim 1 wherein the first surface flange (20) for fastening the lid and the second surface flange (12) are formed in one piece with the drum wall (10).

7. A lidded drum according to claim 1, wherein the stacking rim surface flange (12) is substantially L-shaped in cross-section, having a vertical outer limb (50) and a horizontal inner limb (52), with the horizontal limb (52) being connected directly to the drum wall (14).

8. A lidded drum according to claim 1, wherein the stacking rim surface flange (12), when viewed in cross-section, takes the form of a substantially rectangular handling ring (54) having a lower horizontal locating face (56) and an inner vertical locating face (58) for engagement of the grab claws of a drum grab, with the handling ring (54) being connected to the drum wall (14) via an obliquely downward extending connection web (60), and said connection web (60) serves as a stacking rim.

9. A lidded drum according to claim 1 wherein the drum wall is of substantially conical configuration.

10. A large-capacity blow-moulded lidded drum of thermoplastic material for storing and transporting hazardous liquid or solid contents, comprising:

a drum body (10) having a drum wall (14) that tapers downwardly and exhibits an upper charging opening; and a drum base, said drum wall being provided on its outer wall surface in vicinity of the upper charging opening (16) with a first circumferential, substantially radially projecting surface flange (20) for a gas- and liquid-proof fastening of a drum lid (22) by means of an overlapping tension ring (30) which engages the drum lid (22) and the first surface flange (20), said drum wall further including a stacking rim in the form of a second, substantially radially projecting surface flange (12) extending around the entire circumference of the outer wall surface below said first surface flange to allow nesting of a plurality of such drum bodies, wherein the drum wall extends linearly in a straight line from the first surface flange (20) to the second surface flange (12) and from the second surface flange (12) down to the vicinity of the drum base (18) over its entire outer periphery in the drum longitudinal direction, and has an inner wall surface (36) which is rectilinearly smooth in he region of the first surface flange and of the second surface flange and extends in a linearly straight line from the first surface flange (20) down to the vicinity of the drum base, wherein the stacking rim surface flange (12) is substantially L-shaped in cross-section, having a vertical outer limb (50) and a horizontal inner limb (52), with the horizontal limb (52) being connected directly to the drum wall (14).

11. A lidded drum according to claim 10 wherein the drum body (10) Is provided with a circumferential bottom rolling ring (38) between a lower end of the drum wall (14) and the drum base (18).

12. A lidded drum according to claim 11 wherein the conical drum wall (14) has in the lower region towards the bottom rolling ring (38) a greater degree of taper than in the upper conical drum body (10), such that the bottom rolling ring (38) has a reduced diameter and the radial outer edge (42) of the bottom rolling ring (38) lies within the extension line (42) of the conical drum wall (14).

13. A lidded drum according to claim 11 wherein the bottom rolling ring (38) is formed in one piece with the drum wall (10).

14. A lidded drum according to claim 10 wherein the drum body (10), when viewed in plan, presents a substantially rectangular drum shape with rounded corners (44).

15. A lidded drum according to claim 10 wherein the first surface flange (20) for fastening the lid and the second surface flange (12) are formed in one piece with the drum wall (10).

16. A lidded drum according to claim 10 wherein the stacking rim surface flange (12), when viewed in cross-section, takes the form of a substantially rectangular handling ring (54) having a lower horizontal locating face (56) and an inner vertical locating face (58) for engagement of the grab claws of a drum grab, with the handling ring (54) being connected to the drum wall (14) via an obliquely downward extending connection web (60), and said connection web (60) serves as a stacking rim.

17. A lidded drum according to claim 10 wherein the drum wall is of substantially conical configuration.

18. A large-capacity blow-moulded lidded drum of thermoplastic material for storing and transporting hazardous liquid or solid contents, comprising:

a drum body (10) having a drum wall (14) that tapers downwardly and exhibits an upper charging opening; and a drum base, said drum wall being provided on its outer wall surface in vicinity of the upper charging opening (16) with a first circumferential, substantially radially projecting surface flange (20) for a gas- and liquid-proof fastening of a drum lid (22) by means of an overlapping tension ring (30) which engages the drum lid (22) and the first surface flange (20), said drum wall further including a stacking rim in the form of a second, substantially radially projecting surface flange (12) extending around the entire circumference of the outer wall surface below said first surface flange to allow nesting of a plurality of such drum bodies, wherein the drum wall extends linearly in a straight line from the first surface flange (20) to the second surface flange (12) and from the second surface flange (12) down to the vicinity of the drum base (18) over its entire outer periphery in the drum longitudinal direction, and has an inner wall surface (36) which is rectilinearly smooth in the region of the first surface flange and of the second surface flange and extends in a linearly straight line from the first surface flange (20) down to the vicinity of the drum base, wherein the stacking rim surface flange (12), when viewed in cross-section, takes the form of a substantially rectangular handling ring (54) having a lower horizontal locating face (56) and an inner vertical locating face (58) for engagement of the grab claws of a drum grab, with the handling ring (54) being connected to the drum wall (14) via an obliquely downward extending connection web (60), and said connection web (60) serves as a stacking rim.

19. A lidded drum according to claim 18 wherein the drum body (10) is provided with a circumferential bottom rolling ring (38) between a lower end of the drum wall (14) and the drum base (18).

20. A lidded drum according to claim 19 wherein the conical drum wall (14) has in the lower region towards the bottom rolling ring (38) a greater degree of taper than in the upper conical drum body (10), such that the bottom rolling ring (38) has a reduced diameter and the radial outer edge (42) of the bottom rolling ring (38) lies within the extension line (42) of the conical drum wall (14).

21. A lidded drum according to claim 19 wherein the bottom rolling ring (38) is formed in one piece with the drum wall (10).

22. A lidded drum according to claim 18 wherein the drum body (10), when viewed in plan, presents a substantially rectangular drum shape with rounded corners (44).

23. A lidded drum according to claim 18 wherein the first surface flange (20) for fastening the lid and the second surface flange (12) are formed in one piece with the drum wall (10).

24. A lidded drum according to claim 18 wherein the drum wall is of substantially conical configuration.

* * * * *